US008590939B2

(12) United States Patent
Merzon

(10) Patent No.: US 8,590,939 B2
(45) Date of Patent: Nov. 26, 2013

(54) MULTI-PAGE PRODUCT HANG TAG AND METHOD OF MAKING

(76) Inventor: Adam Merzon, Greenwich, CT (US)

( * ) Notice: Subject to any disclaimer, the term of this patent is extended or adjusted under 35 U.S.C. 154(b) by 899 days.

(21) Appl. No.: 11/222,453

(22) Filed: Sep. 7, 2005

(65) Prior Publication Data

US 2007/0085323 A1 Apr. 19, 2007

(51) Int. Cl.
*B42D 15/04* (2006.01)
*G09F 1/00* (2006.01)

(52) U.S. Cl.
USPC ..... 283/56; 283/109; 40/124.09

(58) Field of Classification Search
USPC ..... 40/124.01, 124.09, 124.19, 124.191, 40/360, 626, 675, 584, 606.01, 606.14, 40/606.15, 124.12, 299.01, 642.02, 651, 40/661.03, 661.11, 359, 630; 281/29, 2, 281/35; 283/107–109, 56, 60.1, 61, 52; 206/459.1
See application file for complete search history.

(56) References Cited

U.S. PATENT DOCUMENTS

| | | | | | |
|---|---|---|---|---|---|
| 2,757,793 | A * | 8/1956 | Deitz | ..... | 206/462 |
| 3,206,225 | A * | 9/1965 | Oleson | ..... | 281/29 |
| 3,346,104 | A * | 10/1967 | Marsh | ..... | 206/472 |
| 3,541,698 | A * | 11/1970 | Cole | ..... | 434/322 |
| 3,605,306 | A * | 9/1971 | Diambra et al. | ..... | 40/107 |
| 5,873,513 | A * | 2/1999 | Ong | ..... | 281/29 |
| 6,439,611 | B1 * | 8/2002 | Chen | ..... | 281/29 |

* cited by examiner

*Primary Examiner* — Dana Ross
*Assistant Examiner* — Pradeep C Battula
(74) *Attorney, Agent, or Firm* — Stephen Cannavale, Esq.

(57) ABSTRACT

A multi page product hang tag includes at least one overlay sheet having pages hingedly attached to a spine with the spine attached to a backing sheet. The backing sheet is attachable to a displayable product, e.g., a binder. Each overlay sheet has an interruption between each page and the spine connected by laminate material that forms a hinge along each interruption. In manufacture, an indicia carrying sheet, e.g., stock, is formed to remove material defining each page and spine along with the hinge-defining interruption therebetween. At least one bridge of the sheet extends between each page and spine above and/or below its corresponding interruption. After laminating the formed sheet, additional forming removes each bridge producing a multi-paged overlay sheet that is in turn attached to a backing sheet to form a product hang tag in accordance with the invention.

5 Claims, 4 Drawing Sheets

MULTI-PAGE PRODUCT HANG TAG AND METHOD OF MAKING

FIELD OF THE INVENTION

The present invention relates to a product hang tag or sell tag, and more specifically to multi-page or multi-leave hang tag and method of making such a hang tag.

BACKGROUND OF THE INVENTION

Point of sale presentation is often one of the most important yet underappreciated aspects of successful marketing of retail goods. When product features are easily visible and clearly displayed a potential buyer quickly and easily gains an understanding of the product, its advantages over a competitor's goods, and insight into unique product features which could prove useful in the purchasing decision. It is a well accepted principle that the retail display of products is a substantial factor in marketing success. Where product features, usefulness, advantages and the like can be easily discerned using an economical arrangement carried by the product, sales will typically be greater and returns less.

With certain products, providing an efficient and successful means to display the product and its key features has proved challenging. For example, some school or office products, such as binders or organizers, often have their most useful components and features inside the binder or organizer. Many of the most recent advances in these products have included new and useful internal compartments and attachments. These products, however, are usually packaged and displayed in stores in a manner such that the binder or organizer is packaged in a manner that keeps it closed; making it impossible for a prospective purchaser to see what is inside.

In certain instances, in order to allow a consumer to view the internal components of a binder or organizer, the binder or organizer is packaged, shelved and displayed in a manner such that that a user can manipulate and open the binder to view the internal components. Such an unrestricted display arrangement, however, is not desirable. The constant opening and manipulation of the product by consumers leads to a poor shelf life. As subsequent consumers repeatedly open and view the product, some units can become damaged or deteriorate to the point where they can no longer be offered for sale. Furthermore, loose internal components can be lost or separated from the commercial goods resulting in a high rate of returns and exchanges. Such damaged or deficient products can lead to a lower profit margin for both the retail store and the manufacturer of the product.

In order to prevent the constant consumer manipulation, some binders, organizers or other book like products have been packaged in a manner wherein the product cannot be easily opened at the retail store. In such circumstances, cardboard, paper, plastic or other known packaging material is wrapped around the product such that the product may not be easily opened. In other instances, the product may be packaged in a box, a clamshell package or another type container. Such packaging, however, is also not desirable because the internal components of the packaged product are not easily visible to the consumer. As a result, the advantages of the product over others may not be fully comprehended or appreciated by the consumer.

Furthermore, while some packaging may list or show some of the features, this approach requires considerable consumer effort to ascertain the specific advantages of the packaged product. Furthermore, such a listing of features does not often provide a consumer with an adequate understanding of the spatial arrangement of the featured internal components.

What is needed is a display hang tag that is more versatile and which enables more information to be displayed in a given area. What is also needed is a display hang tag of multi-leaved or multi-page construction that is of economical construction.

SUMMARY OF THE INVENTION

The invention is directed to a multi-page hang tag that is configurable so as to display, for example in one preferred embodiment, the inner components of a book-like or compartmentalized product such as a binder. The hang tag has an overlay sheet that includes a pair of pages hingedly connected to a spine by a web of material that preferably is laminate material of transparent construction. The spine of the multi-page overlay sheet is attached to a backing sheet which is configured to be attached to a binder or other product.

At least one side of the backing sheet includes indicia relating to the product to which the hang tag is attached. At least one side of each page includes indicia of a like nature and in a preferred embodiment both sides of each page contain product-related indicia. As a result of a hang tag constructed in accordance with the present invention having at least one multi-page overlay sheet, increased product-related information is presented using a minimum of hang-tag and product display space or area.

The invention is further directed to a method of manufacturing such a hang tag, including in particular, making the multi-page overlay sheet from a single sheet of paper or card stock. The method includes forming two generally rectangular elongate gaps or interruptions in the sheet, defining a spine separating a pair of pages. Forming carried out in this method step leaves at least one bridge of sheet material connecting each page at least to the spine, if not one another. Forming preferably is performed by punching or stamping the sheet such as using a die, a press, a laser cutter, a fluid injection cutter, or another suitable cutting arrangement.

A material webbing is applied to at least one side of the formed overlay sheet so as to contact at least a portion of each page and at least part of the spine with at least part of the webbing extending across each gap or interruption. In a preferred method, the webbing material is transparent, at least where it contacts each page. In a currently preferred embodiment, the webbing material is flexible, clear and bondable to the overlay sheet. A particularly preferred webbing material is laminate material, such as laminate material made of a polymeric material such as a plastic or the like. If desired, such webbing can be composed of vinyl, polyethylene, polypropylene, or another suitable material that preferably is used as laminate material.

In a preferred method, the formed overlay sheet is laminated on both sides covering substantially the entire surface area of both sides of each page and the spine. Laminate material thus extends on both sides across the gap providing a region of less thickness and stiffness that defines a page hinge therealong. Such a construction produces a durable, aesthetically attractive and yet economical hang tag multi-page overlay sheet.

Additional forming is performed to remove each bridge. This forming step preferably is performed after the laminating step but can be carried out substantially coextensive therewith if desired. When bridge removal is completed, a multi-page overlay sheet constructed in accordance with the invention is produced having a hinge between each page and the spine that is defined by interconnecting laminate material in each corresponding gap.

In one preferred embodiment, the method of manufacturing a hang tag having pages hingedly attached to a spine includes the steps of providing a piece of paper stock that includes a first page, an second page and spine between the first and second page. First and second oblong or rectangular gaps are generated along opposite sides of the spine with one gap disposed between the spine and one page and the other gap disposed between the spine and the other page. Further defining each gap is an upper or lower bridge of paper stock that connects the spine to at least one of the pages. In one preferred embodiment, each gap is defined by an upper bridge and a lower bridge with the upper bridge connecting the top of the spine to the top of at least one page and the lower bridge connecting the bottom of the spine to the bottom of at least one page. The paper stock is then laminated. Following lamination, the bridges are removed leaving each page connected to the spine only by laminate material extending across the gaps.

In a preferred embodiment, the first gap and the second gap are generated by punching the paper stock with a die. In a preferred embodiment, the method further includes the step of attaching the spine with one or more staples to a precut backing sheet configured for attachment to a commercial product such as a binder. In another preferred embodiment, the attached commercial product is a binder that includes multiple internal sections connected to a ring and the pages of the hang tag include graphical representations of the internal sections printed upon them.

In one preferred embodiment, a hang tag having pages hingedly attached by laminate to a spine is made by the process of providing a first piece of card stock, generating two elongate slits in the card stock such that the slits have an upper and a lower end that define bridge portions located above the upper end and below the lower end of the slits, laminating the card stock and removing the bridge portions such that the pages are pivotable along the laminated slits between said pages.

In one preferred embodiment a product display hang tag includes a backing sheet configured for attachment to a commercial product and a front sheet attached to the backing sheet. The front sheet includes a spine, first and second pages hingedly connected to the spine by a laminate layer applied across the first page, second page and spine. In a preferred embodiment, the front sheet is attached to the backing sheet by staples inserted through the spine of said front sheet into the backing sheet and both sides of the front sheet and the backing sheet include printed graphics. In another preferred embodiment, the first page, second page, and spine are all cut from a single piece of paper stock.

In one preferred embodiment, a method of manufacturing a product hang tag includes providing a backing sheet having a front and back side formed from a first sheet of paper stock. A second sheet of paper stock is also provided. First and second vertically aligned elongate gaps are punched within a central region of the second sheet of paper stock. The gaps define a spine between first and second pages, an upper bridge and a lower bridge. The second sheet of paper stock is laminated such that the laminate extends across the first page and the second page and between the first and second gaps. The laminated second sheet of paper stock is then punched to remove the upper and lower bridges, and the second sheet of paper stock is attached to the front side of the backing sheet.

In one preferred embodiment, a method of manufacturing a product display tag from a single sheet of card stock includes punching two elongate slits in the card stock, laminating the card stock and removing the excess laminated card stock above the upper end of said slit and said lower end of said slit.

Objects, features and advantages of the invention include a laminated multi page product hang tag equipped with a multi-page overlay sheet having a hinge that is mountable to a backing sheet of the hang tag that allows a consumer to view the internal components of a binder, including in their appropriate spatial relationship, without opening the binder; a multi-page product hang tag arrangement that includes the pages and spine formed of a board of single laminated sheet; a multi page hang tag hang arrangement with hinges that alleviates the need of a consumer to open a binder to view the internal components of the binder or organizer; and a hang tag arrangement that is of economical construction, that is robust, that is reliable, that is long-lasting, that is more durable, that is of simple construction, and which is economical to apply and otherwise use.

Various other features and advantages of the present invention will also be made apparent from the following detailed description and the drawings.

BRIEF DESCRIPTION OF THE DRAWINGS

The drawings illustrate the best mode currently contemplated of practicing the present invention. One or more preferred exemplary embodiments of the invention are illustrated in the accompanying drawings in which like reference numerals represent like parts throughout and in which.

Figure 1:
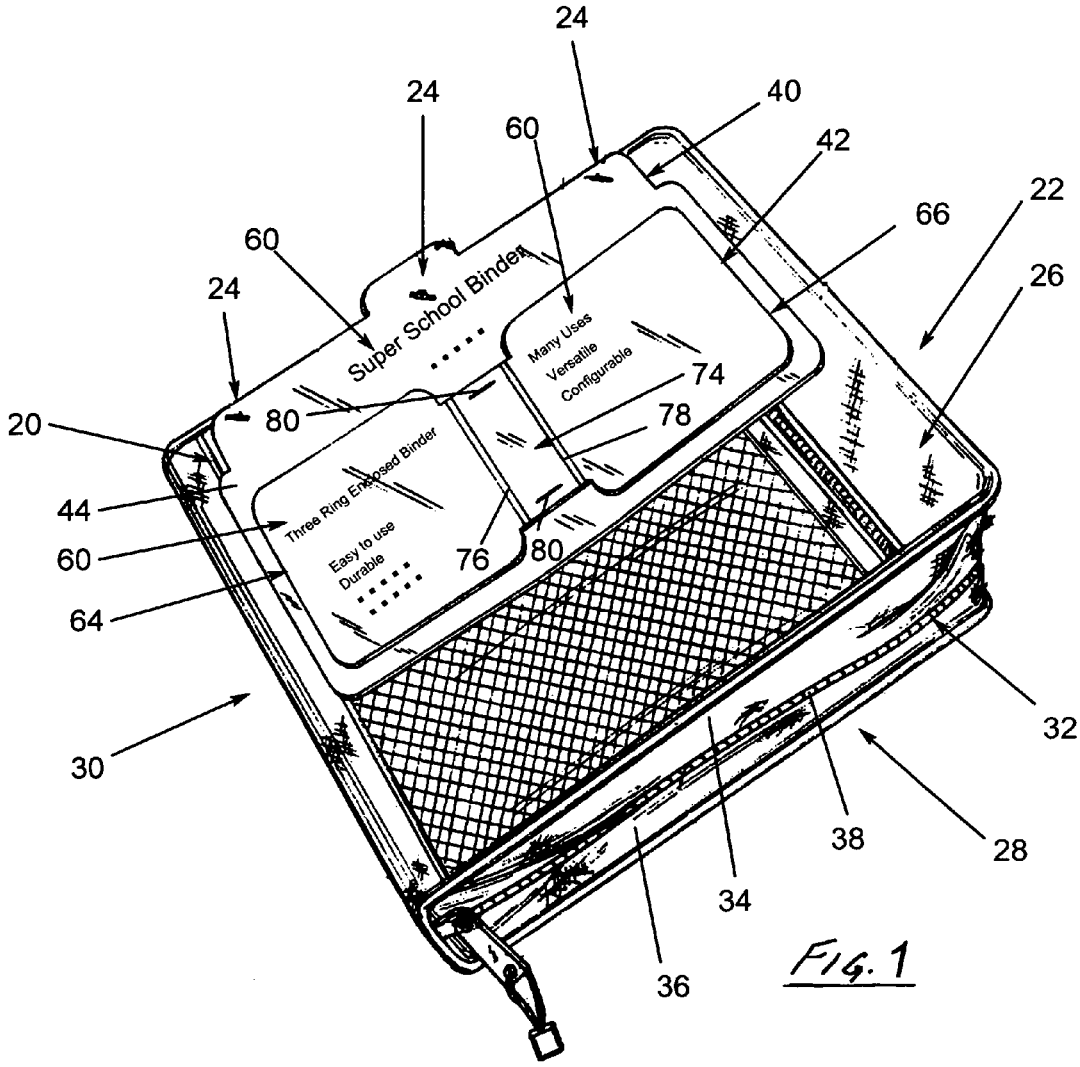
FIG. 1 is a perspective view of a closed binder with a book-like product hang tag attached according to the present invention.

Before explaining one or more embodiments of the invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF AT LEAST ONE PREFERRED EMBODIMENT

FIG. 1 illustrates a preferred embodiment of a product display hang tag 20 of the invention attached to a binder 22.

Hang tag 20 is attached to binder 22 using plastic attachment tabs 24 inserted through the exterior of binder 22 and secured to the hang tag 20, such as is in a manner known in the art. It is understood that hang tag 20 could be attached to wide variety of products other than the illustrated binder 22 and the use of the inventive hang tag 20 with such other products is included in the scope of the present invention. As will become apparent from the description that follows, the particular features of the display hang tag 20 are particularly conducive for commercial display use with, for example, book-like products incorporating a spine and multiple sections or pages.

Binder 22 is of a conventional type known in the art and is depicted in FIG. 1 in a closed position. Binder 22 includes a front cover 26, back cover 28 and a binder spine 30. If desired, the binder 22 can be equipped with a side wall 32 that extends partially circumferentially around the binder 22, such as from the spine 30 within the space defined between the front cover 26 and back cover 28. Front cover 26 and back cover 28 preferably are hingedly connected to spine 30. If desired, the binder 22 can be of spineless construction. As illustrated in FIG. 1, front cover 26 and back cover 28 are substantially aligned or overlap when binder 22 is closed.

Binder side wall 32 is generally comprised of an upper half 34 connected to the front cover 26 and lower half 36 connected to the back cover 28 of binder 22. Releasably connecting the halves 34, 36 of the side wall 32 is a zipper 38. Zipper 38 can be used to secure binder halves 34, 36 together thereby securing and keeping the contents housed within binder 22 together.

Binder 22 defines an internal cavity (not shown). The internal cavity of binder 22 preferably includes a plurality of sections or compartments attached to binder rings. The binder rings may be formed on the inner portions of the spine 30 or alternatively may be attached to the sides of the internal cavity. The internal binder cavity may include, for example, multiple sections such as a zippered pencil pouch, a compact disk storage case, a daily planner, numerous bound folders or other organizational dividers and other related organizational compartments. Preferably, each of the aforementioned sections are attached in some way to the binder 22 thereby facilitating organization and ease of use. Furthermore, the multiple sections of the internal cavity may be accessed by turning each section on attached binder rings. Thus a user can simply flip each section within the binder on the rings as if they were reading a book. Such compartmentalized ring type organizational binders are known in the art and are disclosed in, for example commonly owned U.S. application Ser. No. 10/816,362, filed Mar. 31, 2004, the disclosure of which is expressly incorporated by reference.

Figure 2:
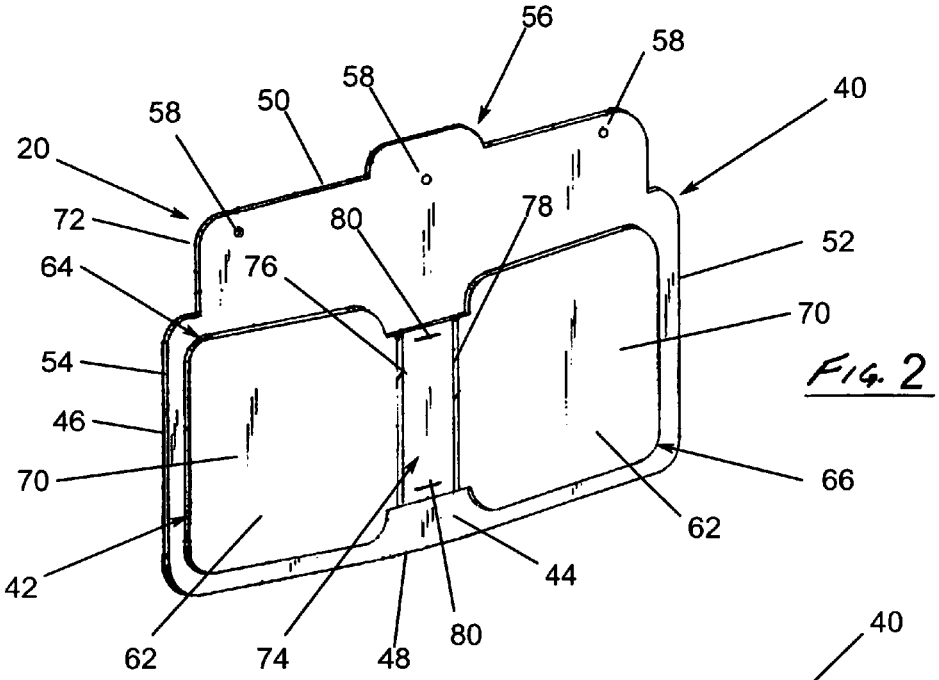
FIG. 2 is perspective view of the hang tag of FIG. 1 with both of the attached pages in an open configuration.
Figure 3:
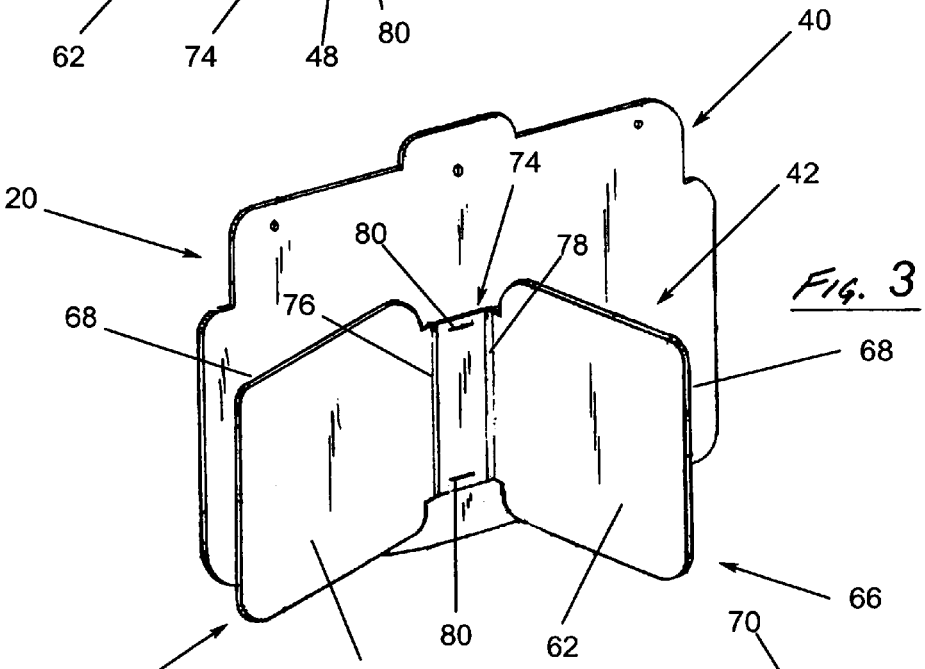
FIG. 3 is a perspective view of the hang tag of FIG. 1 with one of the pages in a partially closed configuration.
Figure 4:
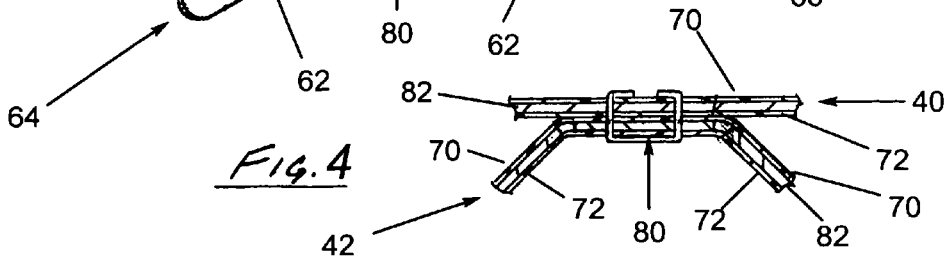
FIG. 4 is a perspective view of book-like hang tag of FIG. 1 with one of the pages closed upon the other.

Referring additionally to FIGS. 2-4, the hang tag 20 preferably includes at least a backing sheet 40 and a multi-page overlay sheet 42 mounted to the backing sheet 40. Backing sheet 40 preferably is a generally rectangular unitary member having a front side 44 and a back side 46. With specific reference to FIG. 2, backing sheet 40 includes a bottom edge 48, top edge 50, right edge 52, and left edge 54. The hang tag backing sheet 40 can have an outwardly projecting tab 56, such as depicted in FIGS. 1-4, which can be conveniently grasped by a prospective purchaser to manipulate the hang tag 20. If desired, one or more holes 58 can be formed in the backing sheet 40, such as for accommodating an attachment fastener, e.g. attachment tab 24 (FIG. 1), or the like.

The backing sheet 40 is formed of a sheet of material 82 (FIG. 4) that preferably is of fibrous construction. Suitable backing sheet material 82 includes card stock, thick paper stock, lightweight cardboard, another fibrous-based stock or sheet material, or the like that is formable by cutting, preferably die-cutting, laser cutting, or the like. The overlay sheet 42 preferably is of like construction and composition.

In one preferred embodiment, the sheet material 82 (FIG. 4) has a thickness of at least 0.5 millimeter and typically has a thickness of between 0.5 millimeter and 2 millimeters. Referring once again to FIG. 1, the sheet material 82 has at least one indicia carrying surface on which indicia 60 is disposed thereon, such as, by printing or the like. While only text indicia 60 is shown in FIG. 1, such indicia 60 can take the form of advertising, logos, trademarks, graphics, instructions, feature listings, description text, etc.

In the preferred embodiment shown in FIGS. 1-4, at least the front 44 of the backing sheet 40 and at least the front 62 of each page 64 and 66 of the overlay sheet 42 contain indicia 60. Preferably, the front 62 and back 68 of each page 64 and 66 contain indicia 60 thereby maximizing the quantity of information conveyable using a minimum of hang tag surface area.

To increase durability and help preserve indicia 60, each sheet 40 and 42 includes at least one layer 70 of webbing that preferably is a laminate material of transparent, e.g. clear, construction. In the preferred embodiment depicted in FIGS. 1-4, the front and back of both sheets 40 and 42 preferably are laminated with at least one layer 70 and 72 of laminate material. Laminate material can be applied in a conventional manner, such as by bonding, using an adhesive, employing heat, or in another manner. Where indicia 60 is applied, it preferably is done before any forming, e.g., cutting, and laminating is performed.

Although backing sheet 40 is illustrated in the preferred embodiment as a generally rectangular member, it is understood that backing sheet 40 could be cut in any variety of shapes, depending on the desired application and associated product. In the illustrated embodiment, backing sheet 40 is cut in a manner such that a graphical representation of the opened binder 22 is printable on its front 44. If desired, such indicia (not shown) can depict the interior of the binder 20, including the inside surface of the front cover 26 and back cover 28 along with any associated features included therein. To provide additional realism, the backing sheet 40, as well as the overlay sheet 42, can be formed, preferably by cutting, to mimic the shape of the article to which the hang tag 20 is attached. In the preferred embodiment depicted in FIGS. 1-4, both sheets 40 and 42 are cut as needed so as to mimic the shape of binder 22.

Attached to the front side 44 of the backing sheet 40 is at least one multi-page overlay sheet 42. In the preferred embodiment, the overlay sheet 42 is configured to mimic part of a binder, e.g., binder 22, including some part of its interior. The overlay sheet 42 includes a pair of pages 64 and 66 with a spine 74 therebetween joined due to laminate material, e.g. 70 and/or 72 (FIG. 4), extending along a corresponding gap 76 and 78 therebetween, defining corresponding hinge regions. The overlay sheet 42 is mounted to the backing sheet 40 by a plurality of staples 80 attaching the spine 74 to the backing sheet 40. With reference to FIG. 3, this construction enables either page 64 or 66 to be turned by pivoting the page along its corresponding hinge region. As a result, indicia 60 on either side of either page can be viewed by a prospective purchaser.

Figure 5:
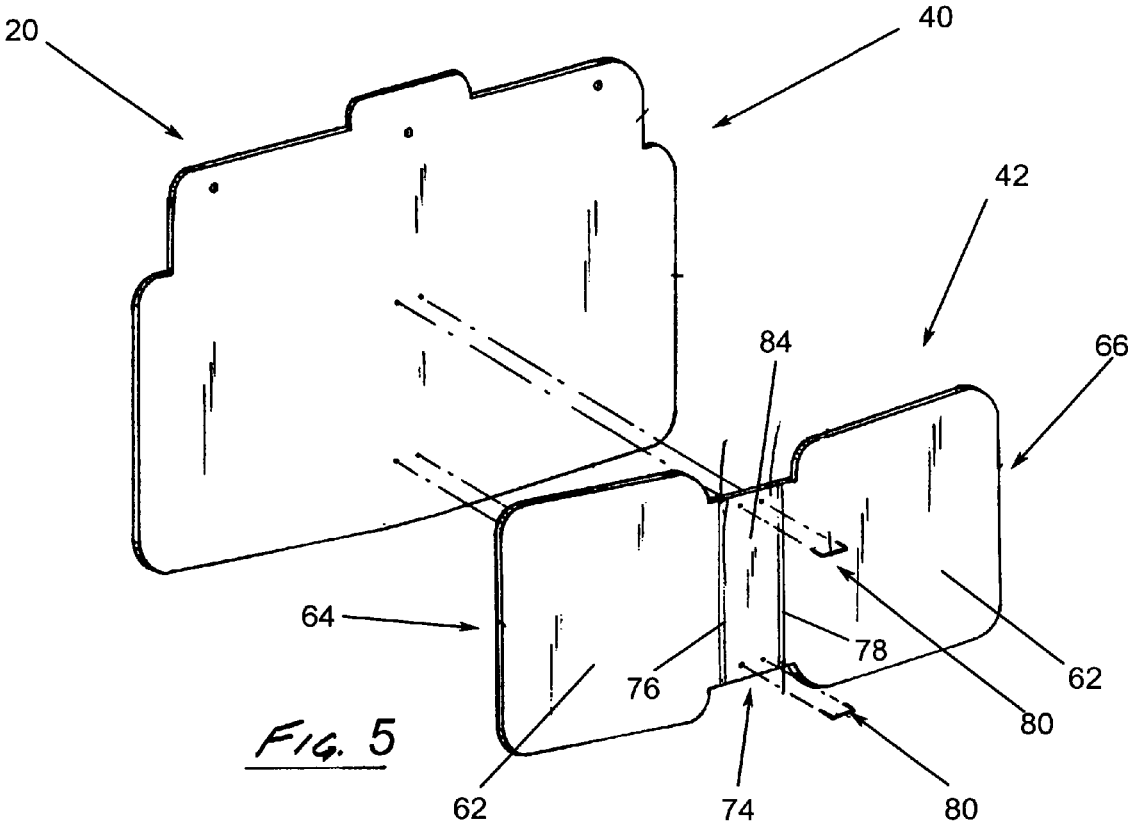
FIG. 5 is a sectional view of the hang tag having the backing sheet and binder portion attached illustrating the attachment mechanisms.
Figure 6:
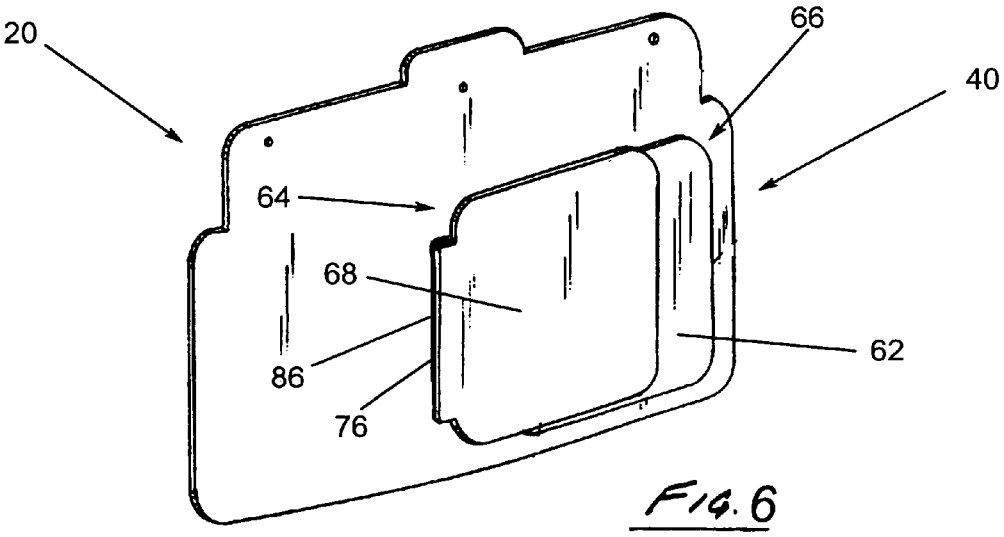
FIG. 6 is a perspective exploded view of the backing sheet and binder portion of the hang tag of FIG. 2.

Referring additionally to FIGS. 5-10 and as discussed below in greater detail, page 64, page 66, and spine 74 are all preferably cut from a single fibrous sheet, preferably paper card stock or the like. As is also illustrated in FIG. 6, multi-paged overlay sheet 42 is assembled to backing sheet 40 via staples 80 inserted through spine 74 and backing sheet 40.

First 64 and second 66 pages are symmetric generally rectangular members cut from printed paper stock or cardboard 82 (FIG. 4). First 64 and second 66 pages include an upper edge, a lower edge, outer side edges and rounded corners. An inner side edge is spaced from an adjacent edge of the spine 74 with the interconnecting laminate material bridging the gap between them defining a hinge region 76 or 78. It is should be understood that first 64 and second 66 pages may be cut in a wide variety of shapes and configurations depending on the particular application and all such modifications are contemplated as being within the scope of the present invention.

Graphics or indicia (not shown) are preferably printed on both the front side 62 and back side 68 of the first 64 and second 66 pages. In at least one preferred embodiment, graphics are printed on each side of the paper stock of the first 64 and second 66 pages such that each side 62, 68 of the pages 64, 66 graphically represent separate sections or compartments of the internal cavity of the binder 22. For example, the back side 68 of first page 64 may have a graphical representation of a compartment such as a CD or DVD case and the front side 62 of the first page 64 may have a representation of another section or compartment such as of a type found in a student planner of the like.

Preferably, both sides of paper stock 82 (FIG. 4) used to form the first 64 and second 66 pages are laminated following an initial cutting stage as will be discussed in greater detail below. Referring to FIGS. 4 and 5, the lamination process results in a front laminate layer 72 and a back laminate layer 74 that preferably extends across the entire multi-page overlay sheet 40.

Spine 74 is a rectangular member cut from the same piece of paper stock 82 used to form first 64 and second 66 pages. Spine 74 also includes a front side 84 and a back side 86. Spine 74 also has top, bottom, and side edges as is shown in FIG. 5. Its side edges preferably substantially align with a corresponding inner side edge of the first 64 and second 66 pages.

Between the side edges of the spine 74 and the inner edges of the pages 64 and 66 are generally rectangular elongate gaps bridged by laminate material 70 and/or 72. The laminate layers 70 and 72 extends across these gaps between the spine 74 and each page 64 and 66 and thus hingedly connects first and second pages 64 and 66 to spine 74. The laminate provides a suitable coating for paper stock while allowing the first and second pages 64 and 66 of each attached overlay sheet 42 to be repeatedly flipped back and forth without cracking or tearing. Such laminate material can be, for example, composed of plastic, e.g., polyethylene, polypropylene, vinyl, etc., another type of polymeric material, a synthetic material of wholly different origin or another material suitable for laminate use.

FIGS. 7-10 depict a preferred method of manufacture of a multi-page hang tag overlay sheet 42 and hang tag 20 in accordance with the present invention. The backing sheet 40 is not shown in FIGS. 7-10 but is cut to size preferably in a manner in accordance with that discussed above using a die cutter, a punch, or the like. Where the backing sheet 40 includes indicia, e.g., indicia 60, the indicia preferably is imprinted before cutting. Thereafter, the cut backing sheet 40 is laminated preferably on both sides. Where equipped with product mounting holes 58, such holes preferably can be formed in the sheet 40 at anytime. In one preferred method, the holes 58 are punched after lamination. In another preferred implementation of a method in accordance with the present invention, the holes are created using self-perforating attachment tabs 24, such as where the tabs 24 are ejected from a tab attachment gun (not shown) or the like.

Figure 7:
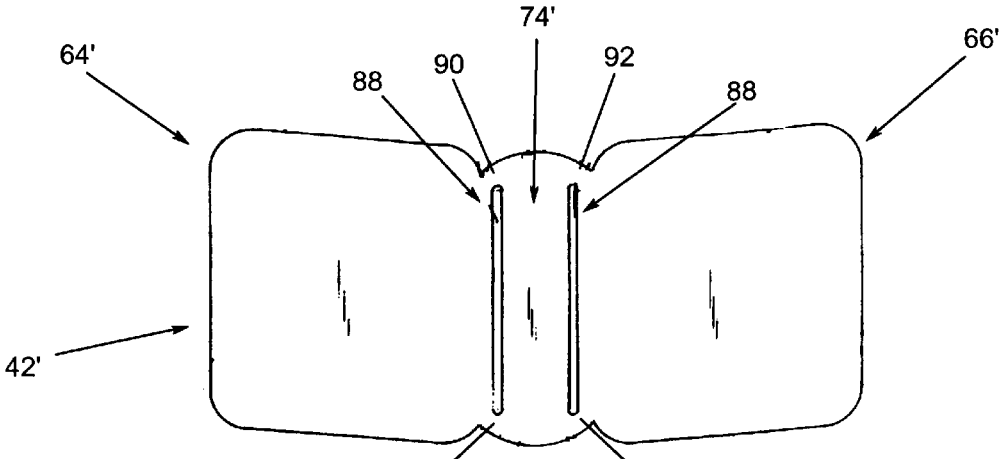
FIG. 7 is a top plan view of the hang tag during assembly after a first cutting step illustrating the slots cut and the resulting upper and lower bridge.

A simulated binder portion, i.e., overlay sheet 42, preferably is manufactured from a single sheet of paper stock 82 (FIG. 4) by first forming a sheet stock blank (not shown) by introducing a pair of elongate and generally parallel gaps or interruptions 88 in it that divide the intermediate formed sheet 42' shown in FIG. 7 into pages 64' and 66' and spine 74'. Each slot-shaped gap 88 preferably is elongate, generally oblong and extends substantially from adjacent a top edge to a bottom edge of the intermediate formed sheet 42'. This forming operation is performed on a sheet blank (not shown) that preferably is rectangular and larger in extent than the resultant intermediate formed sheet 42' shown in FIG. 7.

A material removal process is employed during this forming step. For example, the forming operation preferably is performed by die cutting, punching or by using another suitable cutting process. In a currently preferred embodiment and method implementation, die cutting or punching is employed to remove sheet material to form the slot-shaped gaps 88 bounding each side edge of the spine 74'.

As is shown in FIG. 7, the die or punch is configured to completely remove sheet material to form each one of the slot-shaped gaps 88 such that the gaps 88 extend completely through the sheet 42'. In addition, the die or punch is configured to leave at least one bridging segment that extends from the spine 74' to each page 64' and 66'. In a presently preferred method implementation, this forming step leaves bridging segments 90, 92, 94 and 96 that temporarily join each page to the spine 74' along each end of each gap 88 producing an intermediate formed sheet 42' in accordance with that shown in FIG. 7.

Figure 8:
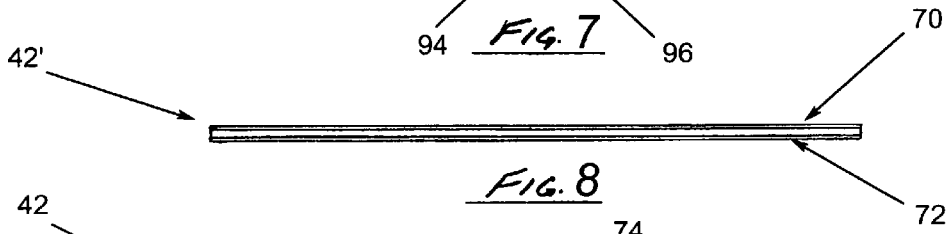
FIG. 8 is a side view of the hang tag of FIG. 7.

Referring to FIG. 8, at least one layer of webbing is applied to at least one of the outer surfaces of the intermediate formed sheet 42'. The webbing is bonded to the sheet surface such as via an adhesive coating, application of pressure, application of heat, or a combination of one or more thereof. The webbing is applied at least along part of each gap 88 in a manner that extends from the page 64' or 66' on one side of the gap 88 to the spine 74' on the other side of the gap 88. While the webbing can be pre-printed with indicia itself, it preferably is transparent, especially where it is desired for indicia of the sheet 42' to be viewable through the webbing. As previously discussed above, the webbing preferably is laminate material, which preferably is applied on both outer surfaces of the sheet all along the sheet surfaces.

In a preferred implementation of making the overlay sheet, a layer of laminate material is applied to both outer surfaces of the intermediate formed sheet 42' shown in FIG. 7. The bridging sections 90, 92, 94 and 96 advantageously maintain the orientation and spacing of the pages 64' and 66' and spine 74' during any subsequent manufacturing operation, including in particular the forming operation discussed below.

Figure 9:
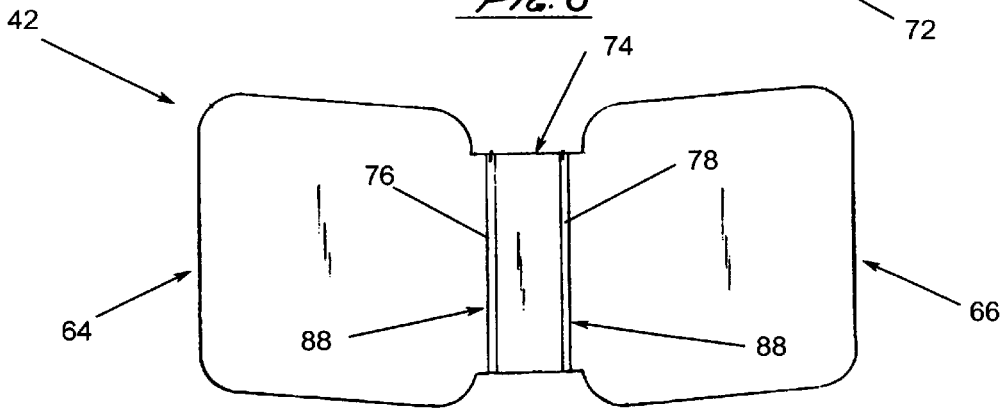
FIG. 9 is a top plan view of the hang tag during assembly after a second cutting step illustrating the upper and lower bridges removed.
Figure 10:
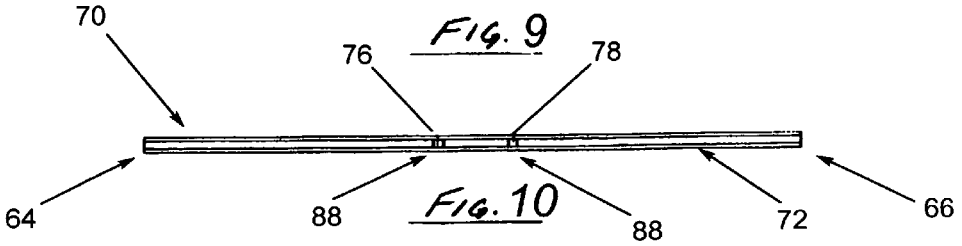
FIG. 10 is a side view of the hang tag of FIG. 9.

Thereafter or concurrently therewith, another forming operation is performed to remove each bridging section 90, 92, 94 and 96 to produce a finished multi-page overlay sheet 42 in accordance with the invention substantially in accord with that depicted in FIGS. 9 and 10. While pages 64 and 66 are oversized and larger than the spine 74, this final forming step can be carried out in a manner that produces differently sized and/or shaped pages.

The final forming step removes the bridging sections 90, 92, 94 and 96 and enough of the oversized portions of the intermediate sheet 42' that each gap 88 preferably is substantially uninterrupted by any sheet or stock material. In the preferred embodiment shown in FIG. 9, each gap 88 is completely uninterrupted by any bridging section and by any sheet or stock material such that only laminate material 70 and/or 72 extends across the corresponding gap 88 to attach each page 64 and 66 to the spine 74 but leaving the corresponding gap 88 shown therebetween. As a result of the thinner, more flexible nature of the laminate material layers 70 and 72 sticking to each other in and along each gap 88, the laminate material layers 70 and 72 defines a corresponding hinge region 76 and 78 (FIGS. 1-3) therein about which each page 64 and 66 can be easily turned when manipulated by a prospective purchaser. By arranging the laminate material layers 70 and 72 toward each other so their bonding surface mates with each other, the portions of the laminate layers stuck together in the hinge regions 76 and 78 advantageously produce a hinge that is strong, durable, resilient, fluid tight, economical, and aesthetically pleasing such that manipulating each page 64 and 66 is easily done without a great deal of effort.

After that, the formed multi-page overlay sheet is attached to the backing sheet preferably completing assembly of the hang tag 20. As previously discussed, the overlay sheet is mounted to the backing sheet using a plurality of fasteners, preferably staples, that engage the spine of the overlay sheet and part of the backing sheet. Thereafter, the hang tag is attached to a retail displayable product such as by using fasteners such as attachment tabs 24 or the like.

It is also to be understood that, although the foregoing description and drawings describe and illustrate in detail one or more preferred embodiments of the present invention, to those skilled in the art to which the present invention relates, the present disclosure will suggest many modifications and constructions, as well as widely differing embodiments and applications without thereby departing from the spirit and scope of the invention.

Various alternatives are contemplated as being within the scope of the following claims particularly pointing out and distinctly claiming the subject matter regarded as the invention.

I hereby claim:

1. A product display hang tag in combination with a binder product comprising: a movable display device having a plurality of alternate information presentation surfaces associated with said binder product a) a backing sheet having apertures adapted to receive fasteners for attachment to the outside surface of said binder product; and b) a front sheet attached to the backing sheet said front sheet overlaying at least a portion of said backing sheet and comprising i. a spine; ii. a first page hingedly connected to said spine; iii. a second page hingedly connected to said spine; and iv. wherein said first page and said second page are connected to said spine by a laminate layer applied across said first page, second page and spine and wherein said front sheet is permanently attached to said backing sheet by staples inserted through the spine of said front sheet into the backing sheet and wherein said first page and said second page are pivot able about said spine from a first position into a second position and wherein said first page and said second page are both located in the same plane which is parallel to said backing sheet when in a first position and wherein said front page and said second page partially overlap each other when either one is in said second position.

2. The product display hang tag of claim 1, wherein both sides of said front sheet and a front side of said backing sheet include printed graphics.

3. The product display hang tag of claim 1, wherein said first page, said second page, and said spine are all cut from a single piece of paper stock.

4. The product display hang tag of claim 2, wherein said printed graphics illustrate at least one internal feature of said binder product.

5. The product display hang tag of claim 1, wherein said backing sheet defines holes configured to receive attachment stubs for attaching said backing sheet to said binder product.

* * * * *